United States Patent [19]
Knutson
[11] 4,290,447
[45] Sep. 22, 1981

[54] ELECTROHYDRAULIC PROPORTIONAL VALVE

[75] Inventor: Dale Knutson, Pewaukee, Wis.
[73] Assignee: Dynex/Rivett Inc., Pewaukee, Wis.

[21] Appl. No.: 82,270
[22] Filed: Oct. 5, 1979
[51] Int. Cl.[3] ..... F15B 13/043
[52] U.S. Cl. ..... 137/596.2; 91/447; 91/464
[58] Field of Search ..... 91/447, 464; 137/596.2

[56] References Cited

U.S. PATENT DOCUMENTS 3,381,587 5/1968 Parquet ..... 91/447 X
3,653,409 4/1972 Brannon ..... 137/625.6 X
4,011,891 3/1977 Knutson et al. ..... 137/625.64 X

*Primary Examiner*—Gerald A. Michalsky
*Attorney, Agent, or Firm*—John J. Byrne

[57] ABSTRACT

Disclosed is an electrohydraulic proportional valve comprising an electromagnetic force motor, a pilot actuator assembly, and a main spool and body assembly. The pilot actuator assembly comprises a pilot spool slidably received in a pilot sleeve and a feedback spool which has a camming surface against which the pilot sleeve rides. The camming surface comprises a first portion in which the position of the pilot sleeve is a function of the axial position of the camming surface and a second portion immediately adjacent the first portion in which the position of the pilot sleeve is constant regardless of the axial position of the camming surface.

The main spool and body assembly comprises a main spool connected to the pilot actuator assembly, first and second load holding check valves slidably disposed in a bore, first means for communicating pilot supply pressure to a reduced diameter area on the main spool when it is the float position, and second means for communicating pilot supply pressure from the reduced diameter area on the main spool to the bore between the first and second load holding check valves when the main spool is in its float position.

8 Claims, 14 Drawing Figures

FIG. 5A
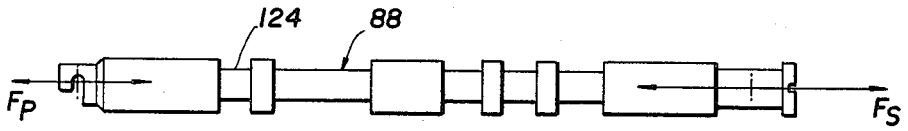
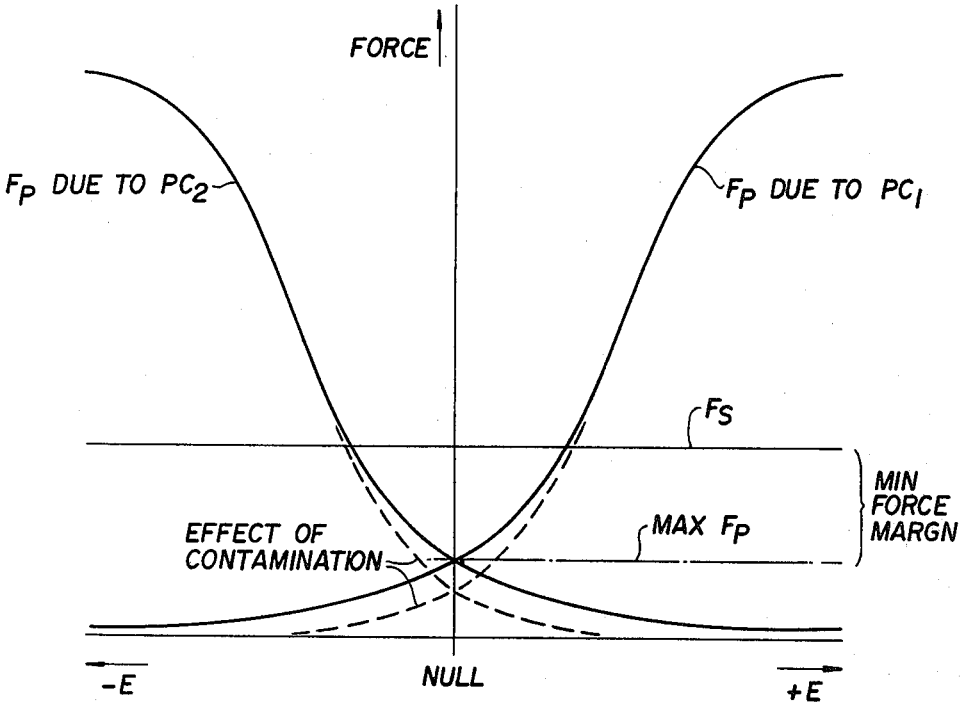
FIG. 5B

ELECTROHYDRAULIC PROPORTIONAL VALVE

TECHNICAL FIELD

This invention relates to electrohydraulic proportional valves suitable for use in selective control valve applications. In particular, it relates to a fourway, electrohydraulic flow control valve with continuously variable output flow which is proportional to the electrical input signal.

BACKGROUND OF THE PRIOR ART

Dynex/Rivett has developed several electrohydraulic control devices over the past several years which employ the same basic design principles as those described herein. These products have been refined through years of field evaluation and laboratory testing into reliable, easily maintained, durable products. However, this same process of continuous field evaluation and laboratory testing has shown the existence of room for considerable improvement, particularly in the area of integrating additional fluid control functions into a single, compact assembly. In particular, in many applications it is necessary for the main spool to have a "float" position whereby the two working parts of a four-way valve are both simultaneously connected to the return line. In these same applications, it is often necessary to totally block the flow from the work ports back to the return line whenever the main spool is in the neutral position. The blocking of flow from the work ports back to the return line is usually accomplished by means of load-holding check valves which prevent a machine member from slowly drifting due to fluid leakage through the annular clearances between the main spool and the valve body.

The "float" position is preferably located at one extreme end of the main spool stroke, and thus it is essential that the main spool consistently achieve full stroke even under adverse conditions such as battery rundown and electrical line voltage drops. Two-stage electrohydraulic proportional valves which employ a means of feedback between the main spool position and the pilot stage generally have great difficulty in achieving a consistent "float" position. This difficulty arises from the fact that the feedback rate between the main spool and the pilot stage is typically constant throughout the total range of main spool movement. Thus a full rated electrical signal must be applied to move the main spool to the "float" position, and relatively small input voltage drops may prevent the main spool from achieving a full "float" condition.

In applications requiring both a "float" position and load-holding check, some means must be provided to open the load-holding check valves whenever the main spool is moved to the "float" position so that fluid can freely pass from either or both work ports to the return line. In the past this has been accomplished by using an additional pilot valve, either electrically or manually operated. Typically this additional pilot valve and associated load-holding check valves were separate components in the hydraulic circuit, thus resulting in additional hydraulic and electrical circuitry.

Additionally, it has been found highly desirable to minimize the effect of contaminants in the hydraulic fluid on the operation of the valve.

OBJECTS OF THE INVENTION

It is, therefore, a general object of the invention to provide an electrohydraulic proportional valve which is improved in the area of integrated fluid control functions.

It is a particular object of the invention to provide such a valve having a "float" position and integral load holding check valves.

It is a further object of the invention to provide a means of opening the load-holding check valves automatically whenever the main spool of the proportional valve is moved to the float position.

It is a still further object of the invention to provide such a valve in which battery rundown or line losses do not limit the ability of the pilot actuator to move the main spool to the full "float" position provided that at least a predetermined minimum voltage can be applied to the electro-magnetic force motor.

Another object of the invention is to provide such a valve in which the effect of contaminants in the hydraulic fluid on the operation of the valve is minimized.

Other objects and advantages of the present invention will become apparent from the appended detailed description of a preferred embodiment taken in conjunction with the accompanying drawings.

BRIEF SUMMARY OF THE INVENTION

The subject electrohydraulic proportional valve comprises an electromagnetic force motor, a pilot actuator assembly, and a main spool and body assembly.

The pilot actuator assembly comprises a pilot spool slidably received in a pilot sleeve and a feedback spool which has a camming surface against which the pilot sleeve rides. The camming surface comprises a first portion in which the position of the pilot sleeve is a function of the axial position of the camming surface and a second portion immediately adjacent the first portion in which the position of the pilot sleeve is constant regardless of the axial position of the camming surface.

The main spool and body assembly comprises a main spool connected to the pilot actuator assembly, first and second load holding check valves slidably disposed in a bore, first means for communicating pilot supply pressure to a reduced diameter area on the main spool when it is the float position, and second means for communicating pilot supply pressure from the reduced diameter area on the main spool to the bore between the first and second load holding check valves when the main spool is in its float position.

BRIEF DESCRIPTION OF THE DRAWINGS

FIGS. 5A and 5B are, respectively, a freebody diagram of the main spool and a graph used to illustrate the effect of contaminants in the hydraulic fluid on the operation of the valve.

DETAILED DESCRIPTION OF A PREFERRED EMBODIMENT OF THE INVENTION

Figure 1:
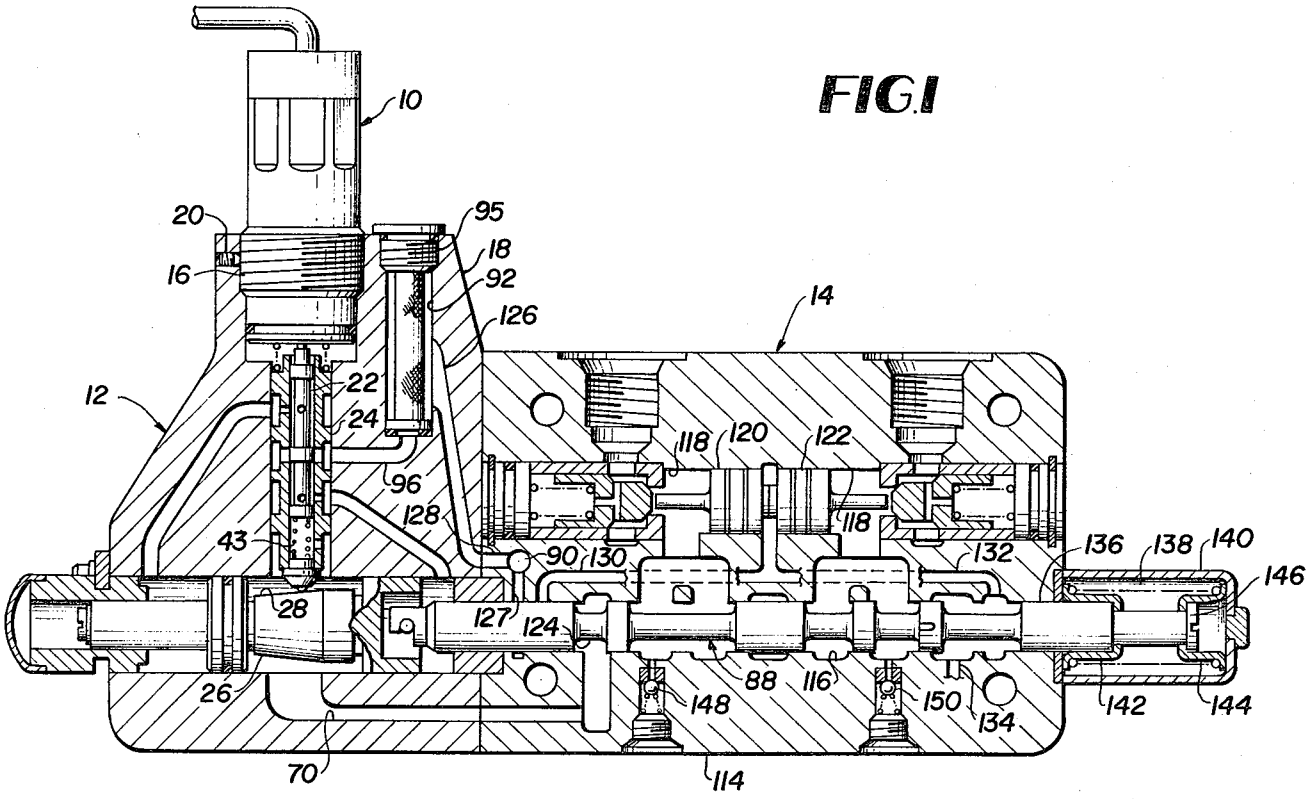
FIG. 1 is a partly cross-sectional view of an electrohydraulic proportional valve according to the present invention.
Figure 2:
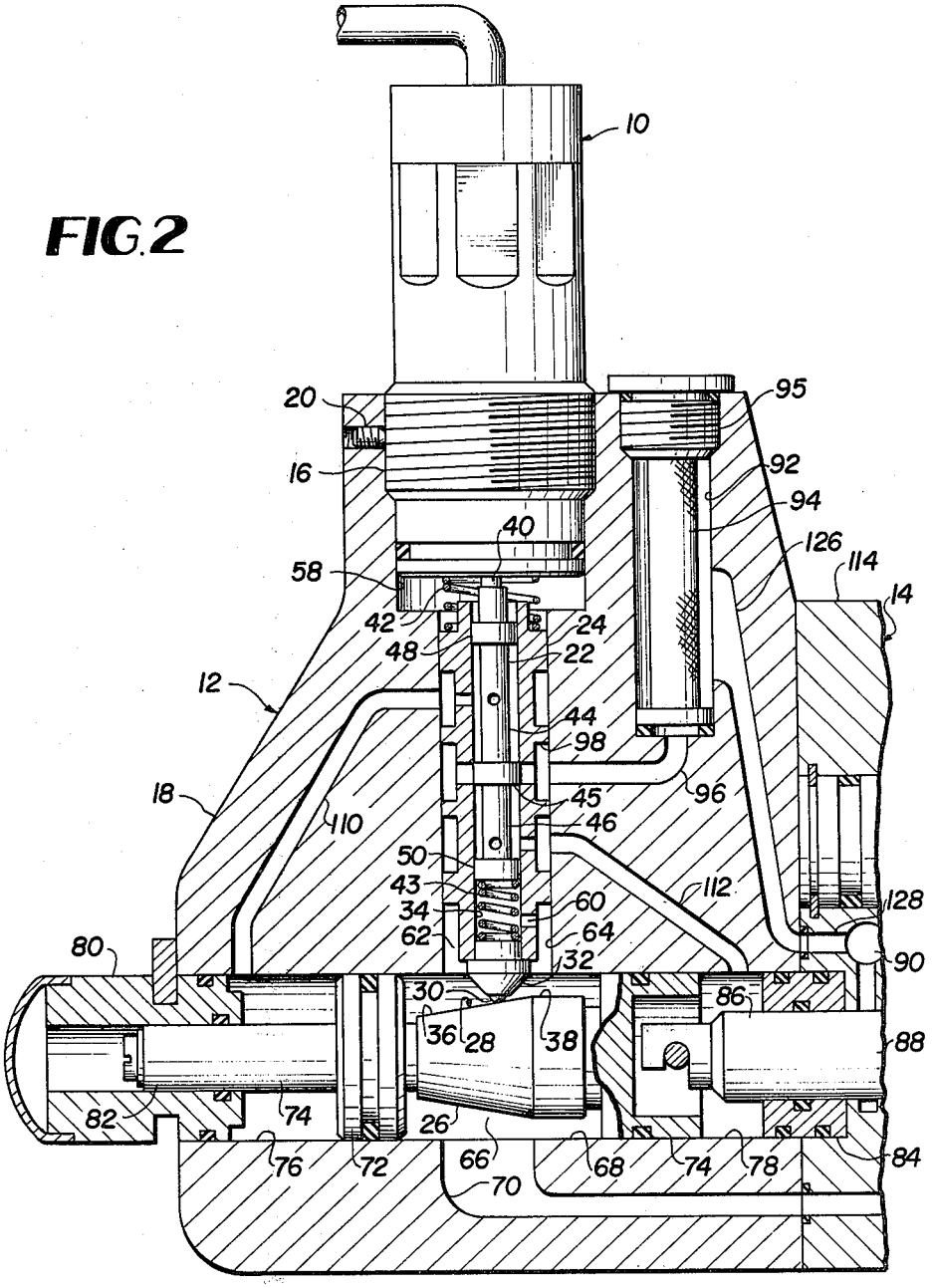
FIG. 2 is a partly cross-sectional view on an enlarged scale of the electromagnetic force motor and the pilot actuator assembly of the valve shown in FIG. 1.
Figure 3A:
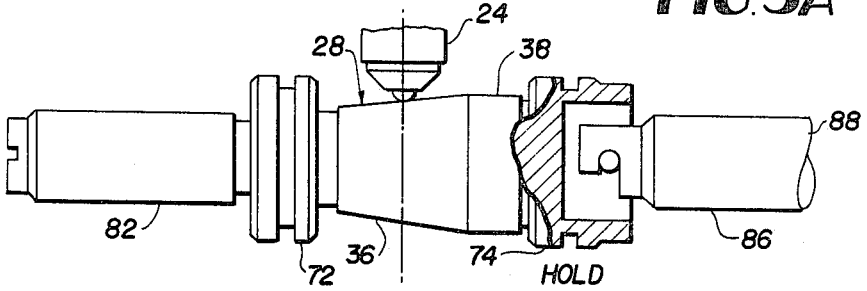
FIGS. 3A through 3D are schematic views used to illustrate the action of the feedback spool.
Figure 3B:
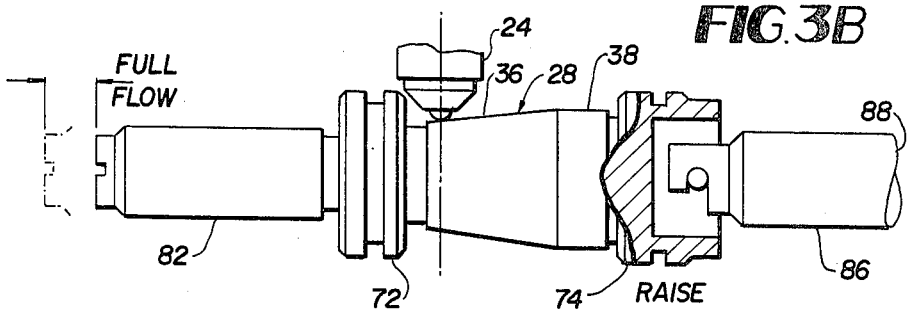
Figure 3C:
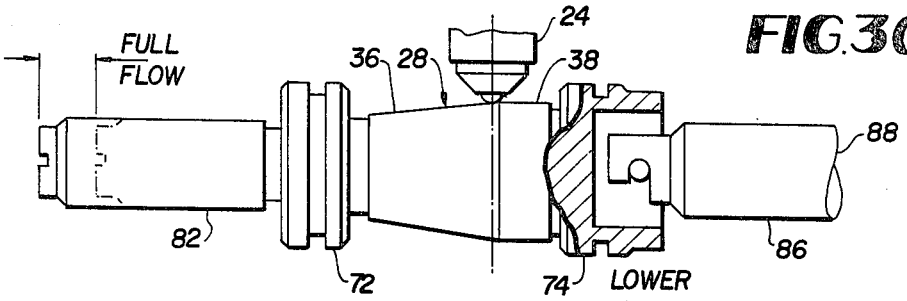
Figure 3D:
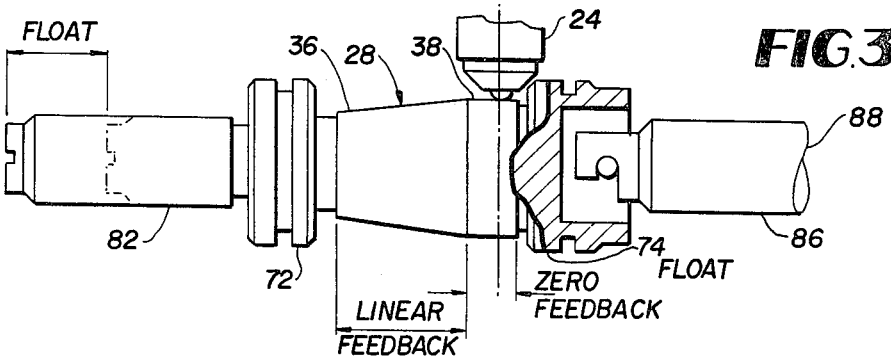

The electrohydraulic proportional valve shown in FIGS. 1 and 2 comprises an electromagnetic force motor 10, a pilot actuator assembly 12, and a main spool and body assembly 14. Each of these assemblies is designed as a complete and separate unit for field servicing. The force motor 10 is threaded into the pilot actuator assembly 12 at 16, and the pilot actuator assembly 12 can be detached from the main spool and body assembly 14 by removing two mounting screws (not shown).

The electromagnetic force motor 10 is a bidirectional device which produces a linear output displacement which is proportional to the magnitude and polarity of the electric signal. The magnetic circuit of the force motor contains permanent magnets which create a polarizing magnetic flux in the working air gaps. The coil flux interacts with the permanent magnet flux to move the armature in one direction or the other depending upon the polarity of the electric signal. The armature of the force motor is spring-centered so that it always returns to a neutral position upon the loss of the electrical signal. The armature is fully suspended from the rest of the force motor assembly. Thus there are no rubbing contacts between the armature and the rest of the force motor assembly, and hysteresis is reduced due to the elimination of frictional forces acting on the armature. Additionally, the force motor cavity is flooded with oil in order to eliminate the use of small dynamic seals which would be subjected to a large number of cycles and which would place undesired frictional forces on the armature assembly.

Since the force motor 10 is mounted on the pilot actuator assembly 12 by means of threads 16, the force motor 10 can be nulled to the pilot actuator assembly 12 by merely screwing the force motor 10 in or out of the pilot actuator body 18 until the desired null position is achieved. Once nulled, the force motor 10 is locked in position by means of a set screw 20.

The pilot actuator assembly 12 comprises a pilot spool 22 slidably received in a pilot sleeve 24 and a feedback spool 26 having a camming surface 28 against which the pilot sleeve 24 rides. To minimize frictional forces between the pilot sleeve 24 and the camming surface 28, the working surface of the pilot sleeve 24 is a ball bearing 30 captured in a plug 32 which is force fit in the internal bore 34 which also receives the pilot spool 22.

The camming surface 28 comprises a first portion 36 in which the position of the pilot sleeve 24 is a function of the axial position of the camming surface 28 and a second portion 38 immediately adjacent the portion 36 in which the position of the pilot sleeve 24 is constant regardless of the axial position of the camming surface 28. In particular, in the illustrated embodiment the portion 36 is linear, and that portion of the feedback spool 26 is in the shape of a truncated cone. However, other shapes of the portion 36 of the camming surface 28 and of the feedback spool 26 are obviously possible and are within the contemplation of this invention.

The pilot spool 22 is in direct contact with the output member 40 of the force motor 10. A spring 42 is disposed between the force motor 10 and the pilot sleeve 24 to bias the pilot sleeve 24 towards the feedback spool 26, and a spring 43 is disposed between the plug 32 and the pilot spool 22 to bias the pilot spool 22 towards the output member 40. Thus motion of the output member 40 results in corresponding motion of the pilot spool 22, and the pilot sleeve 24 remains in contact with the feedback spool 26 regardless of its axial position.

Figure 4A:
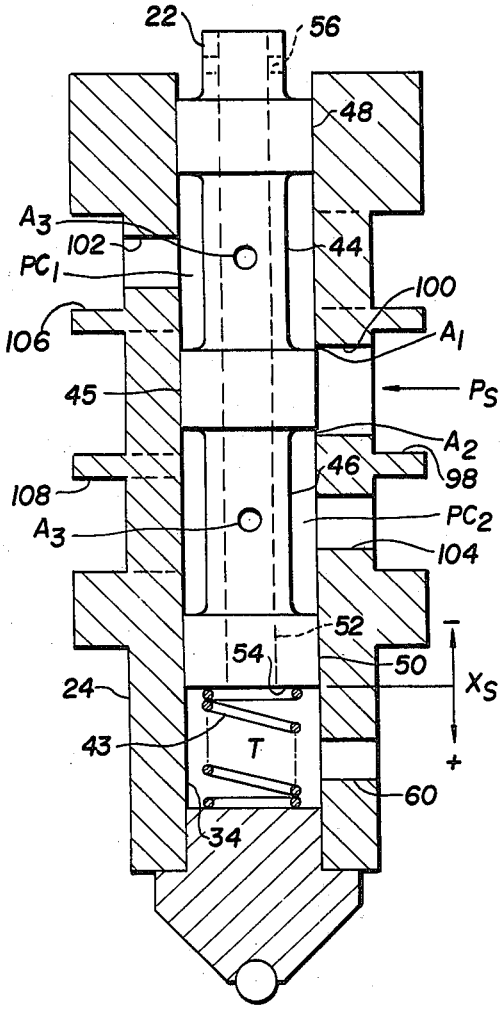
FIGS. 4A through 4C are, respectively, an enlarged cross-sectional view of the pilot spool and the pilot sleeve, a hydraulic circuit diagram, and a graph used to illustrate the effect of contaminants in the hydraulic fluid on the operation of the valve.

The pilot spool 22 comprises a central piston 45 snugly received in the bore 34 in the pilot sleeve 24, first and second reduced diameter areas 44 and 46 on either side of the central piston 45, and first and second distal pistons 48 and 50 snugly received in the bore 34 on either side of the reduced diameter areas 44 and 46. As shown in FIG. 4A, the pilot spool 22 has an internal bore 52 which opens into the bore 34 at 54 and passageways A3 leading through the reduced diameter areas 44 and 46 to the bore 52. The bore 52 is also open at the other end, but since that end of the pilot spool 22 is in contact with the output member 40 of the force motor 10, a passageway 56 is provided to ensure fluid communication between the bore 52 and a chamber 58. Hydraulic fluid from the chamber 58 in turn floods the force motor cavity, as previously stated.

A passageway 60 in the pilot sleeve 24 provides fluid communication between the bore 34 past the distal piston 50 and a chamber 62 defined by a reduced diameter portion of the pilot sleeve 24 and a bore 64 in the pilot actuator body 18 which slidably receives the pilot sleeve 24. The chamber 62 communicates in turn with a chamber 66 defined by the camming surface 28 and a bore 68 in the pilot actuator body 18. A passageway 70 is provided leading from the chamber 66 to tank. Thus the force motor cavity, the chamber 58, the bore 52, the bore 34 past the distal piston 50, the chamber 62, and the chamber 66 are all maintained at tank pressure.

In addition to the camming surface 28, the feedback spool 26 comprises first and second pilot pistons 72 and 74, one located on either side of the camming surface 28. The bore 68 and the pilot pistons 72 and 74 define first and second control chambers 76 and 78 located on the opposite sides of the pilot pistons 72 and 74 from the camming surface 28. The control chamber 76 is closed by a plug 80 which slidably receives an extension 82 of the feedback spool 26, and the control member 78 is closed by a plug 84 which slidably receives an extension 86 of the main spool 88.

Pilot supply pressure is communicated to the pilot actuator assembly 12 through a bore 90 in the main spool and body assembly 14 (shown in section in FIGS. 1 and 2), a passageway 128 in the main spool and body assembly 14, and a passageway 126 in the pilot actuator assembly 12. The passageway 126 opens into a chamber 92 containing a replaceable pilot filter 94. Access to the chamber 92 to replace the pilot filter 94 is provided by a threaded plug 95. A passageway 96 communicates pilot supply pressure from the chamber 92 to the bore 64 adjacent a reduced diameter area 98 in the pilot sleeve 24. A passageway 100 through the reduced diameter area 98 in the pilot sleeve 24 in turn communicates the pilot supply pressure to the reduced diameter area 44 and/or the reduced diameter area 46, depending on the position of the pilot spool 22 in the pilot sleeve 24. From the reduced diameter areas 44 and 46 a portion of the pilot supply is communicated to tank through the passageways A3, as previously explained. The pilot supply is also communicated through passageways 102 and 104 in the pilot sleeve 24 to reduced diameter areas 106 and 108 in the pilot sleeve 24. From the reduced diameter areas 106 and 108 the pilot supply pressure is in turn communicated to the control chambers 76 and 78 via passageways 110 and 112, respectively.

Turning to FIG. 4A, it will be seen that the passageway 100 through the pilot sleeve 24 is just larger in cross-section than the central piston 45. Accordingly, for reasons explained hereinafter, reduced pilot supply pressure is communicated to both reduced diameter area 44 and reduced diameter area 46 when the central piston 42 is in its null position.

As will be apparent from the foregoing, when the pilot spool 22 is moved relative to the pilot sleeve 24 by the force motor 10, it meters the flow of pilot supply pressure to one end or the other of the feedback spool 26, causing it to move axially in the bore 68. As the feedback spool 26 moves back and forth in the bore 68, the pilot sleeve 24 is forced up and down in the bore 64, providing a positive position feedback between the feedback spool 26 and the pilot sleeve 24.

For example, if the pilot spool 20 is moved downward by the force motor 10, pilot flow is directed to control chamber 76, forcing the feedback spool 26 to the right. As the feedback spool 26 moves to the right, the pilot sleeve 24 rides down the camming surface 28 until it again shuts off the flow to control chamber 76. Similarly, if the pilot spool 22 is moved upwardly by the force motor 10, pilot flow is directed to the control chamber 78, forcing the feedback spool 26 to the left. As the feedback spool 26 moves to the left, the pilot sleeve rides up the camming surface 28 until it again shuts off the flow to control chamber 78. Therefore, for every position of the pilot spool 22 there is a corresponding steady-state position of the feedback spool 26.

This unique method of mechanical feedback permits the use of a variable feedback gain throughout the stroke of the main spool 88. As shown in FIG. 3, the feedback gain is reduced to zero for selected voltages—for instance, −6 VDC to −12 VDC signals. This results in the same hard-over "float" position for all voltages in the selected range. Thus normal voltage drops in the electrical system due to battery rundown or line losses do not limit the ability of the pilot actuator assembly 12 to move the main spool to the full "float" position provided that at least a pre-selected minimum voltage (such as −6 VDC) can be applied to the force motor coil.

Figure 4B:
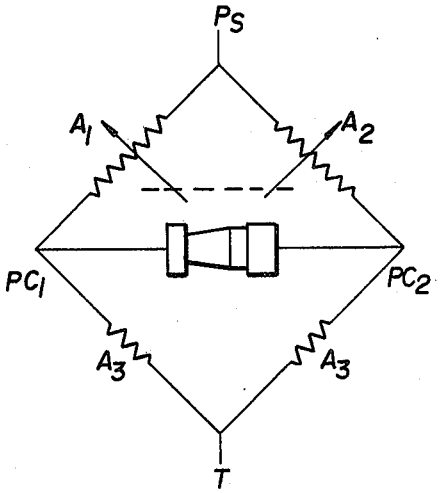
Figure 4C:
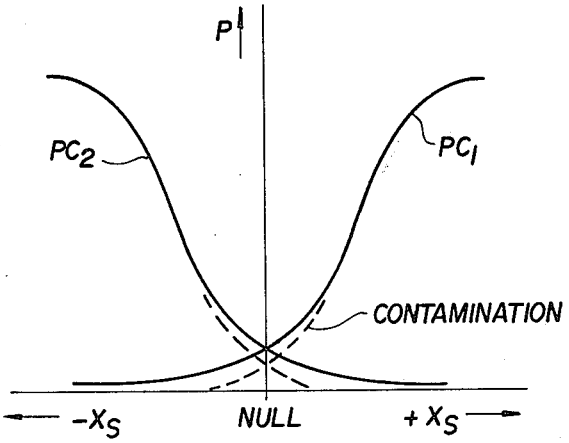

As shown in FIGS. 4A through 4C, the pilot valve is designed such that both the pressure PC1 in control chamber 76 and the pressure PC2 in control chamber 78 are reduced to very low levels when the electrical signal is removed. This is accomplished by making the fixed passageways A3 relatively large, (e.g., 0.025 to 0.030 inches in diameter) compared to the variable passageways A1 and A2 defined by the difference in dimensions between the central piston 45 and the passageway 100. Thus, if contamination in the fluid begins to silt up passageways A1 and A2, as shown in FIG. 4C the effect is to further reduce the pressure in control chambers 76 and 78.

The significance of low null pressures in control chambers 76 and 78 is better shown in FIG. 5A, which contains a free-body diagram of the main spool 88 with the pilot piston forces (Fp) acting on one end of the spool and the spring-centering forces (Fs) acting on the opposite end. As shown in FIG. 5B, the preload force in the spring-centering mechanism attached to the main spool 88 is always greater than the maximum pilot piston force which can be generated if one upstream orifice (A1 or A2) is silted fully closed while the other upstream orifice remains fully open (the worst case possible). Thus the main spool will remain in the "hold" position over long periods of time without the undesired drifting often associated with electrohydraulic proportional control valves.

Returning to FIGS. 1 and 2, it will be seen that the extension 86 of the main spool 88 is attached to the pilot piston 74 by means of a pin/hook arrangement which permits easy removal of the entire pilot actuator assembly 12 to facilitate field servicing. As will be apparent, the connection of the main spool 88 to the pilot piston 74 translates motion of the feedback spool 26 into corresponding motion of the main spool 88.

The main spool and body assembly 14 comprises a main valve body 114 containing a bore 116 in which the main spool 88 is slidably received and a bore 118 in which first and second load holding check valves 120 and 122 are slidably received. The main spool 88 has a reduced diameter area 124, and pilot supply pressure is communicated to the reduced diameter area 124 from the bore 90 through a passageway 127 when the pilot sleeve 24 is in contact with the portion 38 of the camming surface 28. A passageway 130 in the main valve body 114 provides fluid communication from the reduced diameter area 124 to the bore 118 between the load holding check valves 120 and 122 when the pilot sleeve 24 is in contact with the portion 38 of the camming surface 28. A passageway 132 in the main valve body 114 connects the passageway 130 to the bore 116 adjacent a passageway 134 leading to tank.

Figure 6A:
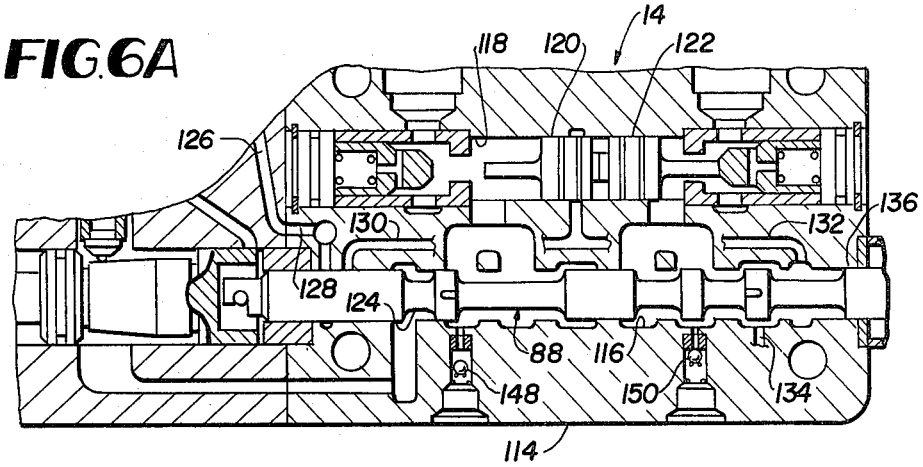
FIGS. 6A through 6C are cross-sectional views of the main spool and body assembly showing it in different positions than it is in FIG. 1.
Figure 6B:
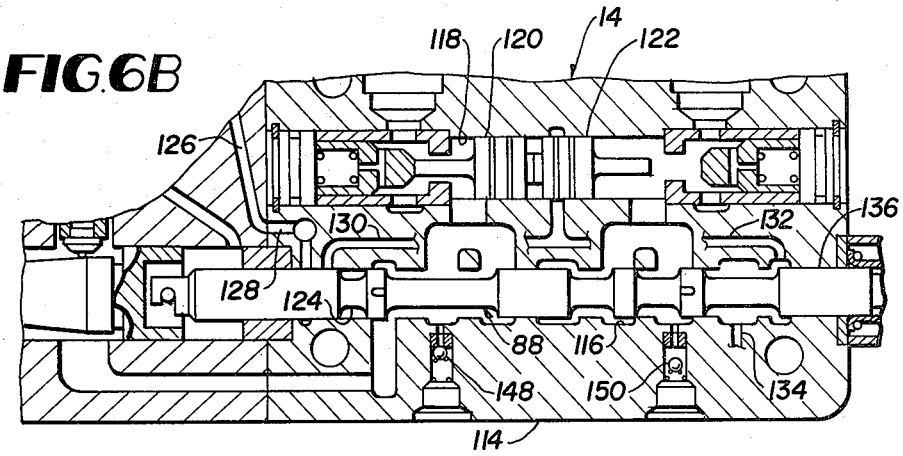
Figure 6C:
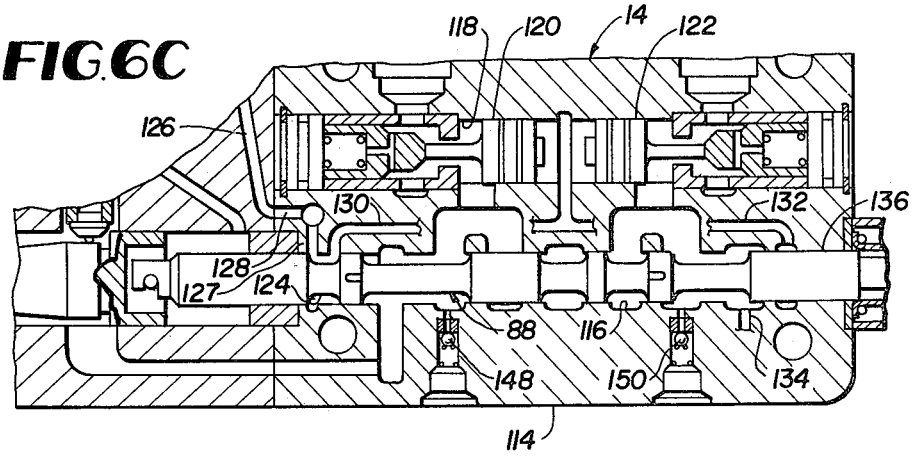

The load holding check valves operate in a conventional fashion during the "hold," "raise," and "lower" modes of operation. As shown in FIGS. 1, 6A, and 6B, the passageway 132 provides communication between tank and the bore 118 between the load holding check valves 120 and 122 during those modes. When the main spool is moved to the "float" position, however (i.e., when the pilot sleeve 24 is in contact with the portion 38 of the camming surface 28 as illustrated in FIG. 6C), pilot pressure is communicated through the passageway 127, the reduced diameter area 124, and the passageway 130 to the bore 118 between the load-holding check valves 120 and 122, the passageway 132 is closed by a land 136 on the main spool 88, and the valves 120 and 122 thereupon separate to open both load-holding poppets. (Of course, the area ratio between the check valve poppets and the plungers must be sized to permit pilot pressure to unseat the poppets at the highest design pressure.)

As previously mentioned, a spring 138, preferably located in the main spool and body assembly 14 and bearing on the main spool 88, biases the feedback spool 26 towards the position wherein the pilot sleeve 24 is in contact with the portion 36 of the camming surface 28. As shown, the spring 138 is conveniently housed in a separate spring housing 140 in which one end bears against a cap 142 seated against the main valve body 114 and the other end bears against a cap 144 carried by a head 146 on the main spool 88. However, many other arrangements for this spring are obviously possible.

Load sensing check valves 148 and 150 are located in the cylinder port passage of each valve segment. They are ported such that only the highest cylinder port pressure is fed back to a compensating spool in the inlet manifold or to a pressure compensating pump.

CAVEAT

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

I claim:

1. An electrohydraulic proportional valve comprising:

(a) a pilot actuator assembly comprising a pilot spool slidably received in a pilot sleeve and a feedback spool having a camming surface against which said pilot sleeve rides, said camming surface comprising a first portion in which the position of said pilot sleeve is a function of the axial position of said camming surface and a second portion immediately adjacent said first portion in which the position of said pilot sleeve is constant regardless of the axial position of said camming surface;

(b) an electromagnetic force motor assembly having an output member which is operatively connected to said pilot actuator assembly such that motion of said output member results in corresponding motion of said pilot spool; and (c) a main spool and body assembly comprising:

(i) a main spool which is operatively connected to said pilot actuator assembly such that motion of said feedback spool results in corresponding motion of said main spool, said main spool having a reduced diameter area;

(ii) first and second load holding check valves slidably disposed in a bore;

(iii) first means of fluid communication for communicating pilot supply pressure to said reduced diameter area when said pilot sleeve is in contact with said second portion of said camming surface; and (iv) second means of fluid communication for communicating pilot supply pressure from said reduced diameter area to said bore between said first and second load holding check valves when said pilot sleeve is in contact with said second portion of said camming surface.

2. An electrohydraulic proportional valve as recited in claim 1 and further comprising a spring biasing said main spool towards a position in which said pilot sleeve is in contact with said first portion of said camming surface.

3. An electrohydraulic proportional valve as recited in claim 2 wherein said spring bears on said main spool.

4. In an electrohydraulic proportional valve as recited in claim 2, wherein (a) said spring imposes a pre-load force on said main spool when said pilot sleeve is in contact with the point on said first portion of said camming surface farthest removed from said second portion of said camming surface;

(b) said pilot actuator assembly contains two variable orifices which are subject to contamination by silt; and (c) said feedback spool is moved by a pilot piston force produced by fluid metered through said variable orifices in said pilot actuator assembly, the further improvement wherein the pre-load force of said spring is greater than the maximum pilot piston force which can be generated if one of said variable orifices is silted fully closed while the other of said variable orifices remains fully open.

5. In an electrohydraulic proportional valve comprising:

(a) a pilot actuator assembly;

(b) an electromagnetic force motor assembly having an output member which is operatively connected to said pilot actuator assembly such that motion of said output member results in corresponding motion of said pilot assembly; and (c) a main spool and body assembly comprising a main spool which is operatively connected to said pilot actuator assembly such that motion of said pilot actuator assembly results in corresponding motion of said main spool, the improvements wherein:

(d) said pilot actuator assembly comprises a pilot spool slidably received in a pilot sleeve and a feedback spool having a camming surface against which said pilot sleeve rides, said camming surface comprising a first portion in which the position of said pilot sleeve is a function of the axial position of said camming surface and a second portion immediately adjacent said first portion in which the position of said pilot sleeve is constant regardless of the axial position of said camming surface;

(e) said main spool and body assembly further comprises first and second load holding check valves slidably disposed in a bore;

(f) said main spool has a reduced diameter area;

(g) said main spool and body assembly comprises first means of fluid communication for communicating pilot supply pressure to said reduced diameter areas when said pilot sleeve is in contact with said second portion of said camming surface; and (h) said main spool and body assembly further comprises second means of fluid communication for communicating pilot supply pressure from said reduced diameter area to said bore between said first and second load holding check valves when said pilot sleeve is in contact with said second portion of said camming surface.

6. An electrohydraulic proportional valve as recited in claim 5 and further comprising a spring biasing said main spool towards a position in which said pilot sleeve is in contact with said first portion of said camming surface.

7. An electrohydraulic proportional valve as recited in claim 6 wherein said spring bears on said main spool.

8. In an electrohydraulic proportional valve as recited in claim 6, wherein (a) said spring imposes a pre-load force on said main spool when said pilot sleeve is in contact with the point on said first portion of said camming surface farthest removed from said second portion of said camming surface;

(b) said pilot actuator assembly contains two variable orifices which are subject to contamination by silt; and (c) said feedback spool is moved by a pilot piston force produced by fluid metered through said variable orifices in said pilot actuator assembly, the further improvement wherein the pre-load force of said spring is greater than the maximum pilot piston force which can be generated if one of said variable orifices is silted fully closed while the other of said variable orifices remains fully open.

* * * * *